United States Patent [19]

Thalenfeld

[11] 4,146,204

[45] Mar. 27, 1979

[54] FOLDABLE DISPLAY HOOK FOR MERCHANDISE DISPLAY RACKS AND THE LIKE

[75] Inventor: David R. Thalenfeld, Beechhurst, N.Y.

[73] Assignee: Trion Industries, Inc., Great Neck, N.Y.

[21] Appl. No.: 790,599

[22] Filed: Apr. 25, 1977

[51] Int. Cl.[2] ..... A47F 5/00

[52] U.S. Cl. ..... 248/220.4; 248/293

[58] Field of Search ..... 248/220.3, 220.4, 221.1, 248/221.2, 240.4, 291, 293, 294, 308; 211/99

[56] References Cited

U.S. PATENT DOCUMENTS

| | | | |
|---|---|---|---|
| 370,214 | 9/1887 | Smith | 248/291 X |
| 954,765 | 4/1910 | Rune | 248/293 X |
| 2,452,689 | 11/1948 | Sheppard | 248/291 X |
| 2,684,226 | 7/1954 | Sundell et al. | 248/294 |
| 3,484,069 | 12/1969 | Larson | 248/221.1 |

FOREIGN PATENT DOCUMENTS

| | | | |
|---|---|---|---|
| 9882 of | 1914 | United Kingdom | 248/294 |

*Primary Examiner*—William H. Schultz
*Attorney, Agent, or Firm*—Mandeville & Schweitzer

[57] ABSTRACT

The disclosure relates to a foldable display hook, for use in connection with perforated panel board and other types of merchandise display racks. The display hook includes a mounting bracket, typically of formed sheet metal, which is adapted to be permanently or removably secured to the display rack. A merchandise supporting member is pivotally secured to the bracket and has stable, detent-retained positions in either of two orientations — extending outwardly from the display rack in normal, merchandise supporting position, and also folded upward into substantially flat relation to the display rack. A display hook assembly having these highly advantageous functions may be manufactured with great economy of two parts, a stamped sheet metal mounting bracket and a formed wire hook member. The hook member is generally of a U-shaped configuration, providing a built-in spring detent action and at the same time providing advantageous safety characteristics.

8 Claims, 7 Drawing Figures

FOLDABLE DISPLAY HOOK FOR MERCHANDISE DISPLAY RACKS AND THE LIKE

BACKGROUND AND SUMMARY OF THE INVENTION

Removable display hooks are widely used in connection with merchandise display. Most typically, such hooks are utilized in connection with perforated panel board, which is provided with a series of uniformly spaced apertures arranged to receive pairs of lugs provided on a mounting bracket for the display hook. The prior art in connection with such hooks is, in general, very well developed, and many varieties thereof are commercially available on the market. In general, such display hooks are convenient and efficient for the setting up of racks and panels for the display of carded and bagged merchandise.

Frequently, manufacturers and jobbers of consumer products prefer to furnish complete, prearranged display assemblies to their retail customers, to simplify and encourage the prominent display of the merchandise in the retailer's store. A highly effective procedure for this purpose is to furnish the retailer with a complete display assembly, including the merchandise, the display rack and the display hooks. Moreover, the manufacturer or jobber achieves greatest benefit if the display panels are preassembled with the display hooks, which not only avoids the necessity of that assembly having to be done on the floor by the retailer, but also assures that the merchandise hooks will be placed most advantageously in the display. Despite the many advantages of such a merchandising policy, the use thereof has been inhibited by the expenses associated therewith. Thus, in one widely used form of preassembled dispaly rack, display panels are formed of wire, and the merchandise hooks are welded to the wire panel frame. These have proven to involve excessively high shipping costs, because of inherent high bulk and also because of the cost occasioned by damage during shipment, or protection against such damage, or both. For example, even where the individual panels of a display assembly are disassembled for shipment, the welded-on merchandise hooks project substantially from the plane of the panel, frequently up to 12 inches. This makes the panels very bulky to ship, resulting in high penalties in shipping rates, because of low weight-to-volume ratios. Moreover, the extended merchandise hooks tend to be easily damaged during shipment, unless expensive packing is provided for protection.

Equally difficult problems arise when using display assemblies in which the display panels are formed of perforated sheets of hardboard, metal or plastic. For such displays, although it is highly desirable to ship the display panels with the merchandise hooks prepositioned in predetermined locations, there has not been available to the trade an inexpensive, practical merchandise hook which could be relied upon to stay in place during the transit. Moreover, assuming that the hook could be retained in position, the above mentioned problems of excessive bulk to rate and concern with damage in transit tends to greatly inhibit the extent of utilization of this otherwise desirable merchandising policy.

Pursuant to the invention, a novel and improved form of merchandise hook is provided, which is suitable for mounting either as a permanent part of the merchandise display or for removable attachment to a perforated panel type of display and which obviates the various disadvantages mentioned above. Moreover, in addition to the outstanding advantages of the device of the invention used in connection with prearranged and preassembled display racks, the device of the invention can be used to great advantage for general application in other, more conventional types of merchandise display.

In accordance with a specific aspect of the invention, a merchandise display hook assembly is provided which includes a base member adapted for mounting to a display rack or panel, either permanently or removably as desired. A merchandise hook is pivotally mounted on the base member for movement between either of two stable positions, a display position in which the hook is rigidly supported in an outwardly extending attitude, and a retracted position, in which the display hook is pivoted upward to lie flat against the panel or rack, upon which it is supported. As a significant aspect of the invention, the construction of the respective parts, the base member and merchandise hook member, is such as to provide an automatic detent interaction, such that the hook tends to be stable in either of its primary positions, but can be easily moved from one to the other.

In its most advantageous form, the display hook assembly of the invention includes a merchandise support hook constructed of a generally U-shaped wire, the ends of which are bent to form pivot shafts. These pivot shafts are received in axially aligned openings in the mounting bracket, to provide for the desired pivotable mounting of the merchandise hook. The mounting bracket itself is formed with laterally deflected cam surface areas, which serve to yieldably displace the legs of the U-shaped merchandise hanger when the hanger is pivoted from either of its stable positions. Because of the yieldable displacement involved in pivotable movement, the merchandise hanger tends to resist movement out of either of its stable positions, but that resistance can be readily overcome by manually pushing or pulling the hanger in one direction or the other.

In accordance with another specific aspect of the invention, a novel merchandise display hook assembly is provided having the features and advantages described above which, in addition, is so designed that the merchandise hanger, when pivoted to its retracted position, is constantly yieldably urged against the rack or panel on which it is mounted. In the case of display hook assemblies mounted on perforated panel board displays, this feature has the important functional advantage of maintaining a constant pressure on the mounting bracket. As a result, when the premounted unit is in transit, any tendency for the display hook assembly to become dislodged is effectively resisted by the constant yieldable pressure maintained on the bracket, which is retained throughout the shipping mode and until the unit is pivoted downward for application thereto of the display merchandise.

Low cost being a highly significant aspect of any display hook assembly of the type contemplated, it is a further aspect of the invention to provide a hook having all of the above mentioned features and advantages which, at the same time, may be produced in large volume at an extremely low cost level. To this end, the new display hook in its most advantageous form is comprised of two simple parts, a stamped, sheet metal base member and a formed wire hanger. The individual components may be manufactured by the most elementary production procedures, and both parts can be easily and inexpensively plated or coated if desired. In addition, a single base member stamping may be utilized to accommodate a wide variety of sizes and forms of merchandise hook.

For a better understanding of the above and other features and advantages of the invention, reference should be made to the detailed description of a preferred embodiment and to the accompanying drawing.

DESCRIPTION OF PREFERRED EMBODIMENTS OF THE INVENTION

Figure 1:
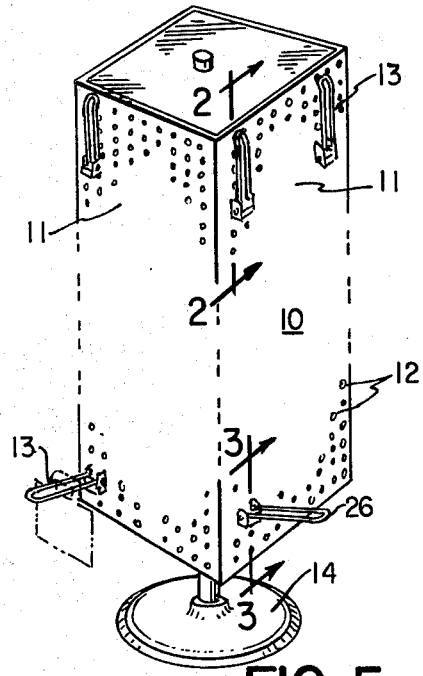
FIG. 1 is a perspective view of an assembled display rack, including perforated board panels and having mounted thereon a plurality of improved display board hook assemblies according to the invention.

Referring now to the drawing, the reference numeral 10 designates generally one of many typical forms of display racks on which the display hook of the invention may be advantageously utilized. The rack may consist of a series of flat panels 11 provided with uniformly spaced perforations 12 for mounting merchandise hooks, generally designated by the numerals 13. The display rack 10, which forms no part of the present invention, typically may be of a knock-down construction, to facilitate shipping. Thus, in the arrangement illustrated in FIG. 1, a series of individual flat panels 11 are erectable into a rack body of rectangular form, which may be mounted on a suitable pedestal 14. For shipping, it is desired that the panels 11 be disassembled and packed in substantially flat relation.

Pursuant to the objectives of the invention, a novel and improved form of merchandise display hook is provided for the rack 10, which includes a base member 15 and merchandise hook 16, both to be described in more detail. The base member 15 is mountable in the panel apertures 12, and the merchandise hanger 16 is arranged to be pivoted on the base member, so as to be foldable flat against the panel 11, as shown in the upper part of FIG. 1, or extending outward therefrom in a merchandise supporting position, as shown in the lower part of FIG. 1.

In the form of the invention illustrated in FIGS. 2–5, the base member 15 is formed of a single piece stamping of sheet metal. The member includes spaced side plates 17, 18, which are arranged to be approximately at right angles to the plane of a perforated panel board 11 on which the hanger is to be supported. The side plates 17, 18 are spaced apart, typically a distance approximating that between pairs of panel apertures 12, and are joined by a supporting bar 19 which extends between the lower front edge portions of the respective side plates.

At the upper rear portions of the side plates 17, 18, there are provided upwardly and rearwardly extending L-shaped lugs 20, which are arranged to be received in the panel apertures 12 and extend upward a short distance along the back surface 21 of the panel, in a generally well known manner. When the base member 15 is properly positioned on the panel board 11, the rear edges 22 of the side plate 17, 18 engage and are supported by the front surface 23 of the panel board. As reflected particularly in FIGS. 2 and 3, the edges 22 of the side plates extend downward from the L-shaped lugs 20.

Each of the side plates 17, 18 is provided with an opening 24 for the reception of short end sections 25 of the merchandise hanger 16, which form, in effect, pivot shafts for that member. To great advantage, the merchandise hanger 16 is formed of wire, in a generally U-shaped configuration. The outer end extremity 26 is rounded and closed, and may be tilted slightly upward, as is reflected particularly in FIG. 7. Elongated and preferably generally straight wire legs 27, 28 extend from the closed end 26 and terminate at the out-turned pivot shaft portions 25. In the design and construction of the merchandise hanger 16, the normal spacing between the outer extremities of the wire legs 27, 28, in the region adjacent the shaft sections 25, is at least slightly greater than the open space between the side plates 17, 18 of the base member 15. Accordingly, in order to assemble the merchandise hanger 16 to the base member 15, the wire legs 27, 28 are yieldably squeezed together, sufficiently to enable the shaft portions 25 to be inserted between the side plates 17, 18. When the shaft sections 25 are aligned with the plate openings 24, the wire legs 27, 28 are allowed to spring outward, so that the shaft portions 25 project through the plate openings. The initial configuration of the U-shaped hanger 16 is such that, after the shaft sections have been projected through the openings 24, the sides of the wire legs continue to press outwardly against the surfaces of the side plates 17, 18.

Figure 2:
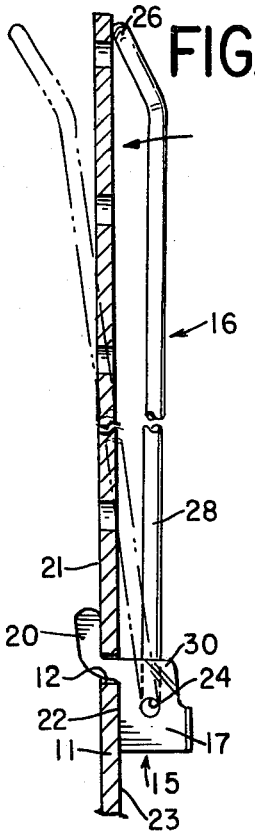
FIGS. 2 and 3 are enlarged cross sectional views as taken generally on lines 2—2, 3—3 respectively of FIG. 1.
Figure 3:
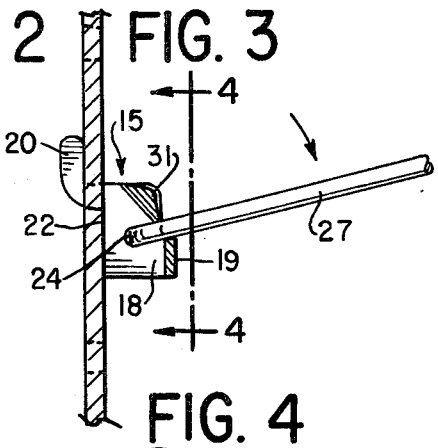
Figure 4:
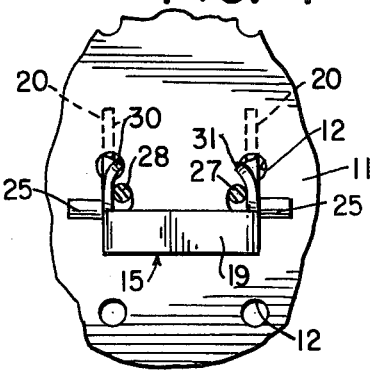
FIG. 4 is a cross sectional view as taken generally on line 4—4 of FIG. 3.
Figure 5:
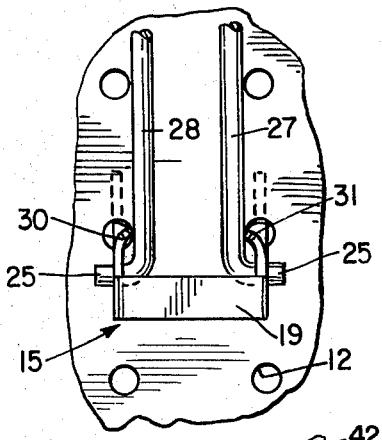
FIG. 5 is a front elevational view, similar to FIG. 4 but showing the display hanger in a partially elevated position.

As is reflected particularly in FIGS. 2 and 3, the pivot openings 24 in the side plates are located, vertically, so as to have a predetermined height relationship with the support bar 19. The arrangement is such that, when the merchandise hook 16 is pivoted downward and forward, to its normal operative position, as reflected in FIG. 3, the hook is rigidly supported by the bar 19. The geometrical arrangement of the parts typically is such that the hook member 16 is inclined slightly upward.

In accordance with one of the significant aspects of the invention, the base member 15 and hanger member 16 are provided with mutually interacting cam detent means which serve yieldably to retain the hanger member in either its extended positions, as shown in FIG. 3, or its retracted position, as shown in FIG. 2. In a highly simplified and economical form, the cam detent means comprises a pair of inwardly angled upper forward corner sections 30, 31 of the respective side plates 17, 18. The corner sections 30, 31 may be bent or curved inwardly more or less along a 45° axis. Typically, the corner extremities of the cam sections 30, 31 are slightly rounded, to provide for relatively easy operation. As reflected in FIG. 5, the inwardly bent cam portions 30, 31 operate to inwardly displace the yieldable wire legs 27, 28 of the hanger member, when the latter is pivoted between extended and retracted positions. The short shaft-like sections 25 of the hanger member are of a length somewhat greater than the maximum inward displacement of the wire legs 27, 28, so that the shaft sections remain engaged with the side plates 17, 18 at all times, while being permitted to slide axially within the openings 24 as necessary to accommodate the cam-displaced movement.

The size and location of the cam sections 30, 31, and the geometric location of the pivot axis formed by the openings 24 are such that the hanger member 16 has an over-center position, approximately halfway between its extended and retracted positions. When the hanger is pivoted fully downward, to its extended position shown in FIG. 3, upward movement of the hanger tends to be resisted by the inward displacement of the wire legs required in order to clear the cam sections 30, 31. Likewise, when the hanger is in its upwardly extending, retracted position shown in FIG. 2, downward pivoting movement of the hanger is again resisted by the cam sections 30, 31, which require the wire legs to be displaced yieldably inward, in order to effect the desired movement. These resistances can, of course, be easily overcome by manually pushing or pulling on the hanger member. Moreover, once the hanger has been drawn past its over-center position, the yieldable action of the wire hanger on the cam sections 30, 31 will tend to cause the hanger member to snap itself into its final extended or retracted position.

Of particular significance to the form of the invention shown in FIGS. 1–5, the geometrical arrangement of the pivot axis, wire legs 27, 28, and cam sections 30, 31, is such that, when the hanger 16 is fully upright and its end portion 26 is in contact with the front surface 23 of a panel board on which the device is mounted, the wire legs 27, 28 preferably are still slightly displaced by the cam sections 30, 31. This tends to urge the hanger member to pivot in a counterclockwise direction (as viewed in FIG. 2, toward the position shown in broken lines) and conversely tends to urge the base member 15 to rotate in the opposite direction. The mounting lugs 20 are thus held tightly against the back of the panel 11, and the hanger 16 is held tightly against the front. In this condition, the display hook assembly is not only in a highly compact form for shipment, but is firmly self-retaining in its preassembled position on the panel board. Preassembly and shipment of the display assemblies is a simple matter of inserting the hook assemblies in the desired positions on the panel board, and then pivoting the hanger member 16 upwardly, beyond their respective over-center positions. The entire assembly is compact and self-retaining, and is easily set up at the display site by simply manually grasping the several hanger member 16 and pulling them downward from their retracted to their extended positions.

To best advantage, the arrangement of the cam portions 30, 31 and hanger legs 27, 28 is such that the hanger member 16 is held under at least slight pressure against the front face of the panel 11. This is a most secure arrangement and minimizes or avoids rattling of the parts during shipment. Nevertheless, at least some of the advantageous features of the invention could be realized even where the hanger member 16 is not held under constant tension against the panel face 23, as long as it is retained against significant pivotal displacement and consequent accidental withdrawal of the base member 15 during transit.

Figure 6:
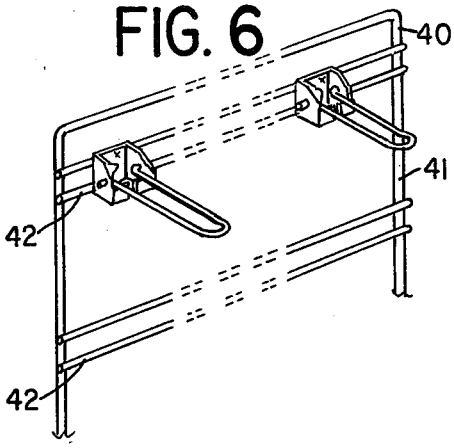
FIG. 6 is a perspective view of a welded wire rack type of display panel, having permanently secured thereto display hook assemblies according to the invention.
Figure 7:
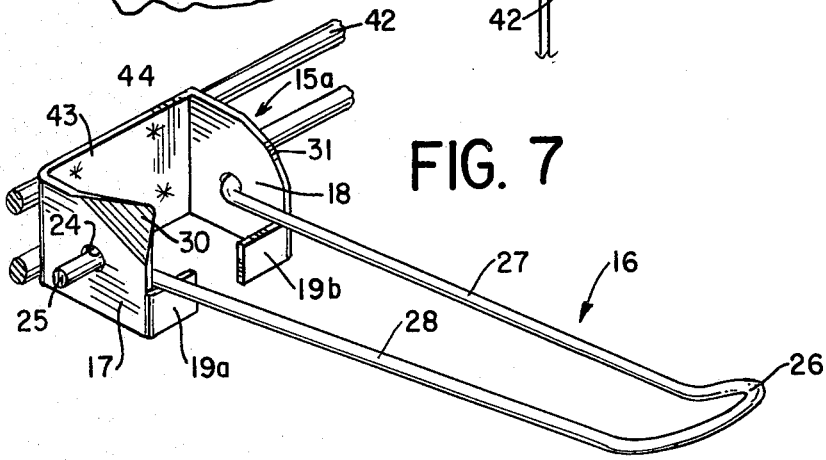
FIG. 7 is an enlarged perspective view of a form of display hook assembly incorporated in the rack of FIG. 6.

A slightly modified form of the invention is illustrated in FIGS. 6 and 7, wherein the base member, generally designated by the numeral **15*a*, is arranged to be permanently secured to a rack 40. The rack 40, which in itself forms no part of the invention, may comprise a frame wire 41, to which are welded or otherwise secured pairs of wire cross bars 42. At appropriate locations on the pairs of cross bars 42 are welded or otherwise permanently secured base members 15*a* which mount, in the manner heretofore described, merchandise hangers 16**.

As reflected in FIG. 7, the base member **15*a* desirably comprises a sheet metal stamping, including a flat back plate 43, which is spot welded at one or more locations 44 to the wire cross bars 42. Side plates 17, 18 extend outward from the back plate 43, and tabs 19*a*, 19*b* extend inward from the lower forward edge extremities of the side plates. The tabs 19*a*, 19*b* perform essentially the same function as the connecting bar 19 of the modification of FIGS. 1–5, and serving as a limit stop and support for the merchandise hanger 16** in its extended position.

In its general functioning and operation, the modification of FIGS. 6 and 7 is the same as described for the modification of FIGS. 1–5, except for the fact that the base member **15*a* is permanently secured to the rack, whereas the base member 15 of the first-described embodiment is removably secured to the panel by means of its lugs 20**.

In any of its various forms, the merchandise display hook of the invention has unique advantages, both from the standpoint of function and economy. The hook may be very inexpensively manufactured and installed and has significant functional advantages in being cam detent retained in either extended or retracted positions.

In modifications of the hook which are adapted for installation in apertured panels, for example, the device of the invention is uniquely advantageous in having a cam detent retained retracted position, and which not only is the merchandise hanger held in a flat, retracted position, but the otherwise removable base member is effectively locked in assembled relation to the apertured panel board during preliminary shipment and handling. This provides a wholly practical and economical arrangement for the rack jobber to preassemble removable merchandise hook assemblies to apertured panel board displays and ship them in such preassembled manner to the retail outlet. By preassembling the display board, the rack jobber not only encourages the retailer to utilize the display by minimizing labor at the destination end, but the rack jobber is also able to preassemble the display panel with assurance that it may be shipped at a minimum of cost and will arrive with the display arrangement of merchandise hooks intact on the display board.

The significant advantages mentioned above are realized, in accordance with the invention, in a display hook assembly which is extremely economical to manufacture and install. The new hook is a simple, two-part assembly, consisting preferably of a stamped, sheet metal base member and a formed, U-shaped wire hook. For assembly, the legs of the wire hook are yieldably displaced and snapped into place in the base member, in a simple assembly operation. Most advantageously, the wire legs fit inside the side plates of the base member, so that a simple squeezing motion is all that is needed for the assembly. Alternatively, the U-shaped wire hanger member may be constructed with in-turned shaft sections, which could be assembled by yieldably outwardly displacing the wire legs. In the latter arrangement, the cam detent arrangement would, of course, displace the wire legs outwardly during pivoting movements of the hanger between extended and retracted positions, and the supporting bar or tabs would extend outwardly rather than inwardly.

While the hook assembly of the invention is ideally suited for utilization of a loop type of merchandise hook, of generally U-shaped configuration, it may also be utilized in the construction of single wire hook assemblies. By way of example, a single wire hook member may be mounted, at its inner end, by a short, U-shaped mounting section, which engages the base member substantially in the manner of the U-shaped hanger 16. Many other modifications will, of course, suggest themselves to those skilled in the art.

In view of the above, it should be readily understood that the above described specific forms of the invention are intended to be representative only, and that certain changes may be made therein without departing from the clear teachings of the disclosure. Accordingly, reference should be made to the following appended claims in determining the full scope of the invention.

I claim:

1. A merchandise display hook or the like, which comprises (a) a base member having spaced side members, (b) a U-shaped hanger member, (c) interengaging pivot means securing said hanger member to said base member for pivotal movement of the hanger member between extended and retracted positions, and (d) cam detent means on at least one of said base and hanger members operative to effect yieldable deformation of at least one of said members when said hanger is pivoted between extended and retracted positions, whereby said hanger member is yieldably retained in one of said positions, (e) said base member being removably received in an apertured panel member, (f) said hanger member, in its retracted position, being yieldably urged against said panel member, whereby to assist in retaining said base member engaged in said panel member.

2. The merchandise display hook of claim 1, further characterized by (a) said base member comprising a generally U-shaped member having panel engaging lugs extending upwardly and rearwardly and spaced side members extending forwardly, (b) said base member being provided with pivot recesses in its side members, (c) said hanger member having axially disposed pivot sections received in said recesses for limited rotational and sliding movement, and (d) said cam detent means being operative to yieldably displace the legs of said hanger member during pivoting movement thereof.

3. A merchandise display hook or the like, which comprises (a) a base member adapted for mounting on a display rack, (b) a hanger member pivotally mounted on said base member for movement between extended and retracted positions, (c) said hanger member being formed of wire and being of generally U-shaped configuration, having spaced-apart leg portions and short sections at each free end bent on a common axis and pivotally connected to said base member, and (d) the free ends of said leg portions being constructed to be resiliently yieldable in a direction generally parallel to the pivot axis of said hanger member; and (e) interacting cam detent means on said base and hanger members for effecting temporary lateral displacement of said leg portions upon pivoting movement of said U-shaped hanger member from one of said positions to the other.

4. The display hook of claim 3, further characterized by (a) said base member being provided with upwardly and rearwardly extending lugs for removable reception in openings of an apertured display panel.

5. The display hook of claim 3, further characterized by (a) said cam detent means comprising laterally projecting portions of said base member.

6. The display hook of claim 5, further characterized by (a) said base member comprising a generally U-shaped, sheet metal member having spaced side members for the pivotal reception of said hanger member, and (b) portions of said side members being bent laterally to engage and laterally displace the leg portions of said U-shaped hanger member.

7. The merchandise display hook of claim 3, further characterized by (a) said base member forming an integral part of a display panel assembly, and (b) said U-shaped hanger member being removably engageable with said display panel assembly.

8. A merchandise display hook or the like, which comprises (a) a base member adapted for mounting on an apertured display panel having a plurality of regularly spaced openings, (b) said base member having one or more generally L-shaped upwardly extending mounting lugs for reception in and removal from said openings, (c) a merchandise hanger member pivotally mounted on said base member for movement between an extended position, at a large angle to the panel, and an upwardly extending retracted position, in relatively flat relation to said panel, (d) said hanger member comprising a generally U-shaped wire member having spaced leg portions, (e) said wire member having short sections at each end bent to be in a common axis and forming pivot shaft means, (f) recess means in said base member adapted to receive said pivot shaft means for rotational and axial movement, (g) interacting support means on said base and hanger members for firmly supporting said hanger member in its extended position, and (h) yieldable interacting retainer means on said base and hanger members operative to yieldably retain said hanger member alternatively in its extended or retracted position, (i) said retainer means, when retaining said hanger member in its retracted position, being operative to yieldably resist pivoting movement of said hanger member away from said panel, (j) said hanger member, when in its upwardly extending retracted position, extending substantially above said upwardly extending mounting lugs whereby to resist accidental dislodgement of said base member from its mounted position on said panel.

* * * * *